US005337857A

United States Patent [19]

Spalt et al.

[11] Patent Number: 5,337,857

[45] Date of Patent: Aug. 16, 1994

[54] LADDER ADAPTABLE PLATFORM

[76] Inventors: Taylor E. Spalt; Gregory P. Spalt, both of 188 Tilden Rd., Scituate, Mass. 02066

[21] Appl. No.: 97,684

[22] Filed: Jul. 27, 1993

[51] Int. Cl.[5] ..... E06C 7/16

[52] U.S. Cl. ..... 182/122; 182/120; 182/103; 248/238

[58] Field of Search ..... 182/129, 222, 120, 122, 182/103; 248/238, 210

[56] References Cited

U.S. PATENT DOCUMENTS

| | | | |
|---|---|---|---|
| 2,182,475 | 12/1939 | Herline | 248/238 |
| 2,557,270 | 6/1951 | Franklin | 248/238 X |
| 3,067,836 | 12/1962 | Carnicelli | 182/121 |
| 5,072,808 | 12/1991 | Spalt et al. | 182/103 |

*Primary Examiner*—Alvin C. Chin-Shue
*Attorney, Agent, or Firm*—Don Halgren

[57] ABSTRACT

The present invention comprises a platform for an aluminum extension ladder which platform is adjustable upwardly and downwardly, and is pivotable between a pair of side frames, to permit a user's foot a comfortable support, in addition to the ladder rung to which it is attached.

8 Claims, 3 Drawing Sheets

LADDER ADAPTABLE PLATFORM

BACKGROUND OF THE INVENTION

1. Field of the Invention

This invention relates to ladders and more particularly to devices for ladders so as to provide an adjustable broader step thereon.

2. Prior Art

There are several different types of extension ladders. Initially they were made of wood, but more recently extension ladders have been made of aluminum or fiberglass. These extension ladders are inherently difficult to stand on for any extended period of time. The newer extension ladders however may have thereacross rungs made into a "D"-shape, in cross section, wherein a flattened side may be disposed across the upper surface thereof. Nonetheless, it is very tiring for a user's leg, to be standing with ones feet disposed across the rung by itself.

The prior art contains a number of patents all of which have a fault wherein the platform upon which the user may place his feet, extends either in front of the rung, or immediately over it, presenting a potential hazard by which the user may trip. For example, U.S. Pat. No. 1,820,315 to Miller shows a step attachment for ladders with a platform which hangs off of the rung, and in front thereof.

U.S. Pat. No. 2,486,783 to Hartman et al shows a platform attachment for rung type ladders also is disposed upon the front side of the ladder and over the rung. And the platform itself raises the tread for the user above the rung. This could be dangerous in as much as the user might inadvertently miss that spot.

U.S. Pat. No. 2,899,011 to Babits shows a ladder step, with a pair of flaps which extend around behind the ladder rails, with fingers which also are disposed around the front side of the ladder rung. A platform portion extends out in front of each rung. Again this is inherently dangerous as the user may trip thereover.

U.S. Pat. No. 3,067,836 to Carnicelli shows an adjustable platform step for extension ladders, again disposed both above the rung and out in front of it. The platform means has a complicated locking device to secure it to the rung, and has an adjustable platform to compensate for the angle of the ladder.

U.S. Pat. No. 3,115,214 to Roberts shows a portable step attachment for extension ladders which hang out in front of the ladder and is secured to a rung thereon. This platform has a central portion which is swingable up and out of the way to permit the user some access therearound. Roberts thereby acknowledges the difficulty with getting over a platform on a ladder, however he fails to deal with the inherent problem of having the platform in front of the ladder rung.

U.S. Pat. No. 4,586,586 to Canals shows a work step for an extension ladder having a platform which is articulable about a rung thereadjacent. The platform has a complicated locking mechanism in which the platform may be held parallel to the side frame of the ladder. The platform extends onto the rung of the ladder and extends slightly forward of it.

U.S. Pat. No. 4,911,265 to Skaggs shows a ladder platform with a rung securing mechanism having a rather complicated locking mechanism which holds the platform onto the next highest rung.

Lastly, my U.S. Pat. No. 5,072,808, incorporated herein by reference, shows a platform which overcame the shortcomings of the aforementioned prior art. My present invention improves yet further upon my earlier platform as described hereinbelow.

BRIEF SUMMARY OF THE INVENTION

The present invention comprises a ladder adaptable platform having a foot supporting generally planar platform surface which extends almost the the length of a rung of a typical extension ladder. The platform surface is journalled on a first transverse support axle. The axle has a pair of ends, each of which is fixedly secured to a side frame. Each side frame has a forward edge having a ladder rail engaging means thereon. The rail engaging means preferably comprises a channel shaped member which matingly engages its respective outer side portions of its associated ladder rail.

A second transverse support axle is spaced apart from yet disposed parallel to the first axle and has a pair of ends each of which is fixedly attached to its respective side frame.

A biasing means is arranged between the platform surface and at least one of the support axles to effect rotation of the platform about its first axle and against its second axle. The biasing means comprises a spring arrangement which causes the pressure of the platform against the second axle.

A pair of fingers extend off of the forward end of the platform, and are arranged to rest upon a desired rung of a ladder on which the user wishes to stand.

Both of the first and second axles are longitudinally adjustable to permit engagement of the channel shaped rail engaging means to fit about the rails of a ladder. Typically, the ladder is of aluminum extrusion, and its side rails are of channel shape, one edge of which is preferably engaged to the engaging means.

BRIEF DESCRIPTION OF THE DRAWINGS

The objects and advantages of the present invention will become more apparent when viewed in conjunction with the following drawings, in which.

DESCRIPTION OF THE PREFERRED EMBODIMENTS

Figure 1:
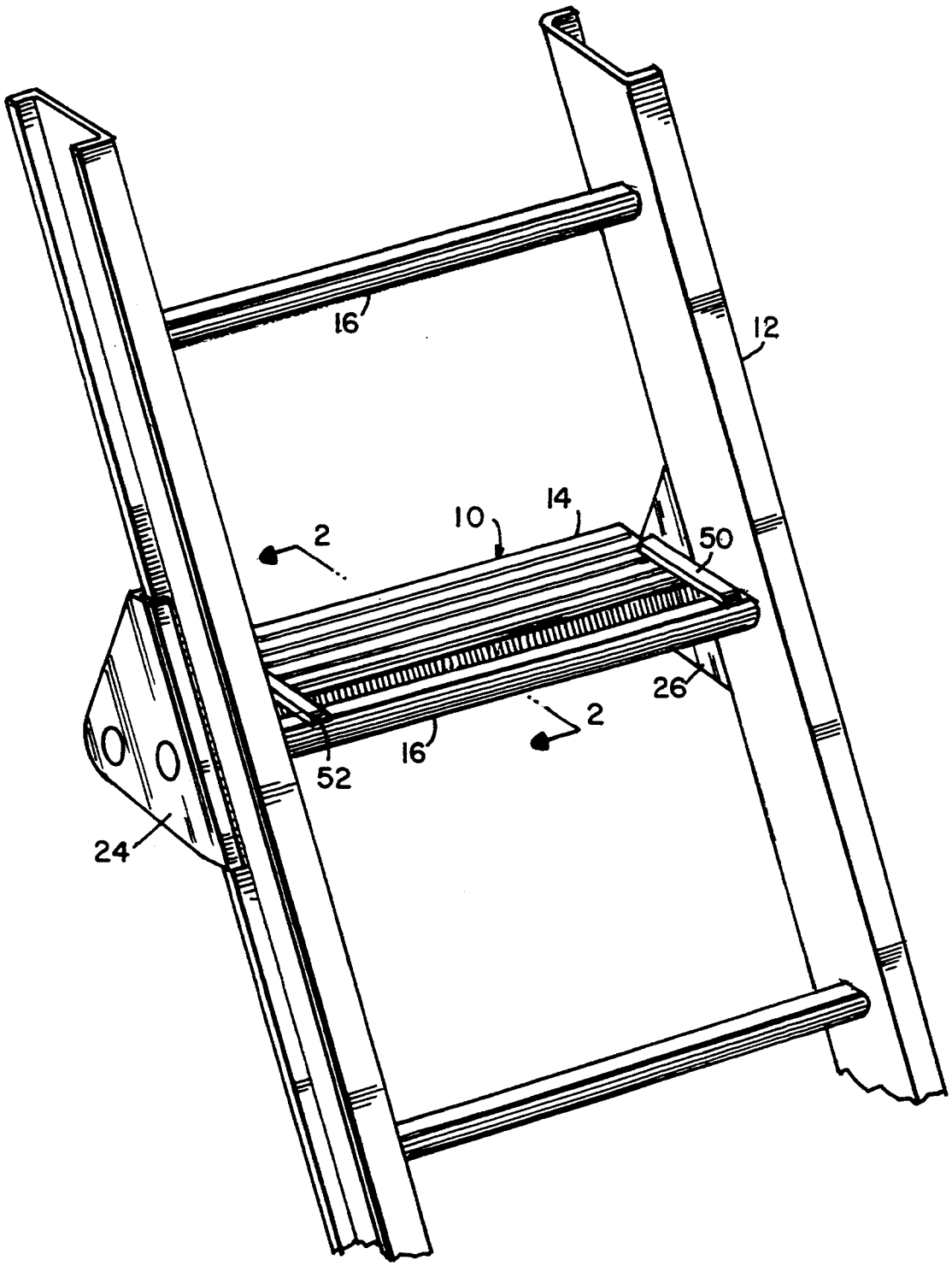
FIG. 1 is a prespective view of a ladder adapter platform shown on a portion of an extruded aluminum extension ladder.

Referring now to the drawings in detail, and particularly to FIG. 1, there is shown a ladder platform assembly 10 on an extruded aluminum extension ladder 12.

The ladder platform assembly 10 comprises a ladder platform surface 14 which extends almost the length of a rung 16 of the extension ladder 12. The platform 14 is journalled on a bearing 18 about a first transverse support axle 20. The first axle 20 has a pair of ends 22, and 22A each of which are fixedly attached to a side frame 24 and 26. Each side frame 24 and 26 has a forward edge 28 having a ladder rail engaging means 30 thereon. The rail engaging means 30 preferrably comprises a channel shaped member which matingly engages its respective outer side portions 32 of its associated side rail 34 of the ladder 12.

A second transverse support axle 34 is spaced apart from yet disposed parallel to the first axle 20 and has a pair of ends 36 and 36A, each of which are fixedly attached to its respective side frame 24 or 26.

Figure 2:
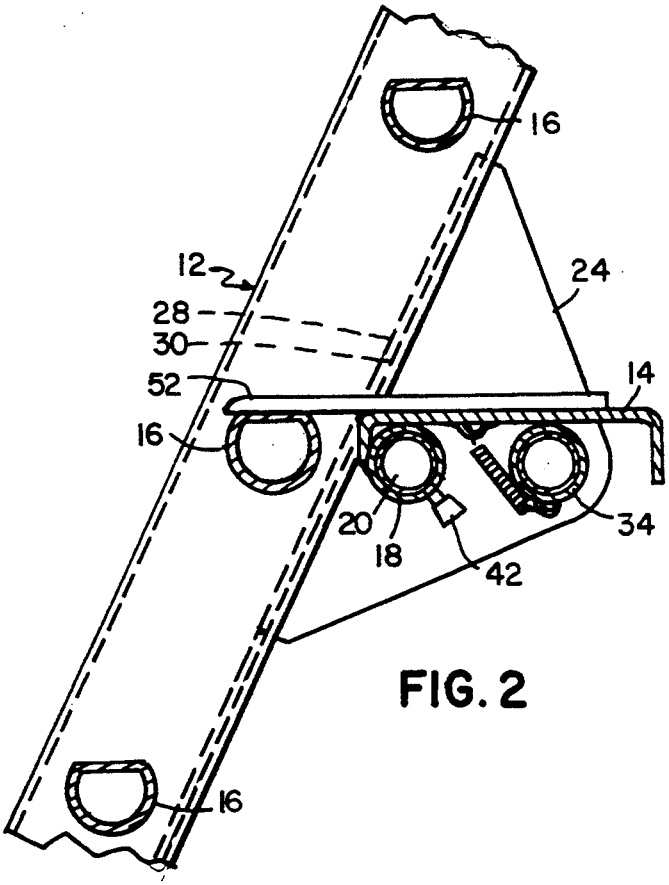
FIG. 2 is a view taken along the lines I—I of FIG. 1.
Figure 3:
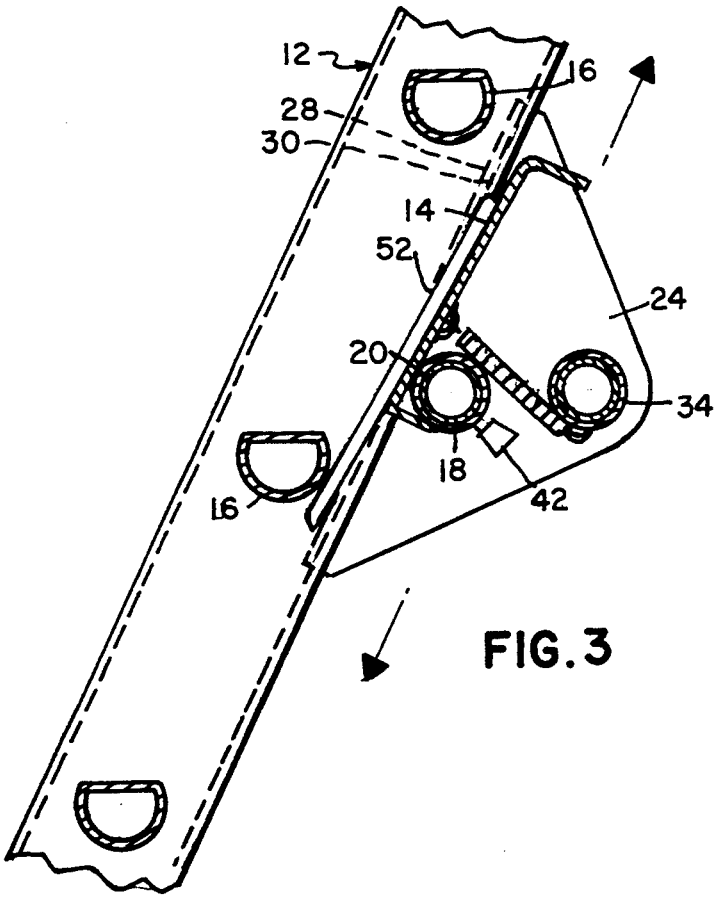
FIG. 3 is a view similar to FIG. 2, showing the platform pivoted about its axis to permit it to be adjusted upwardly or downwardly relative to the ladder.
Figure 4:
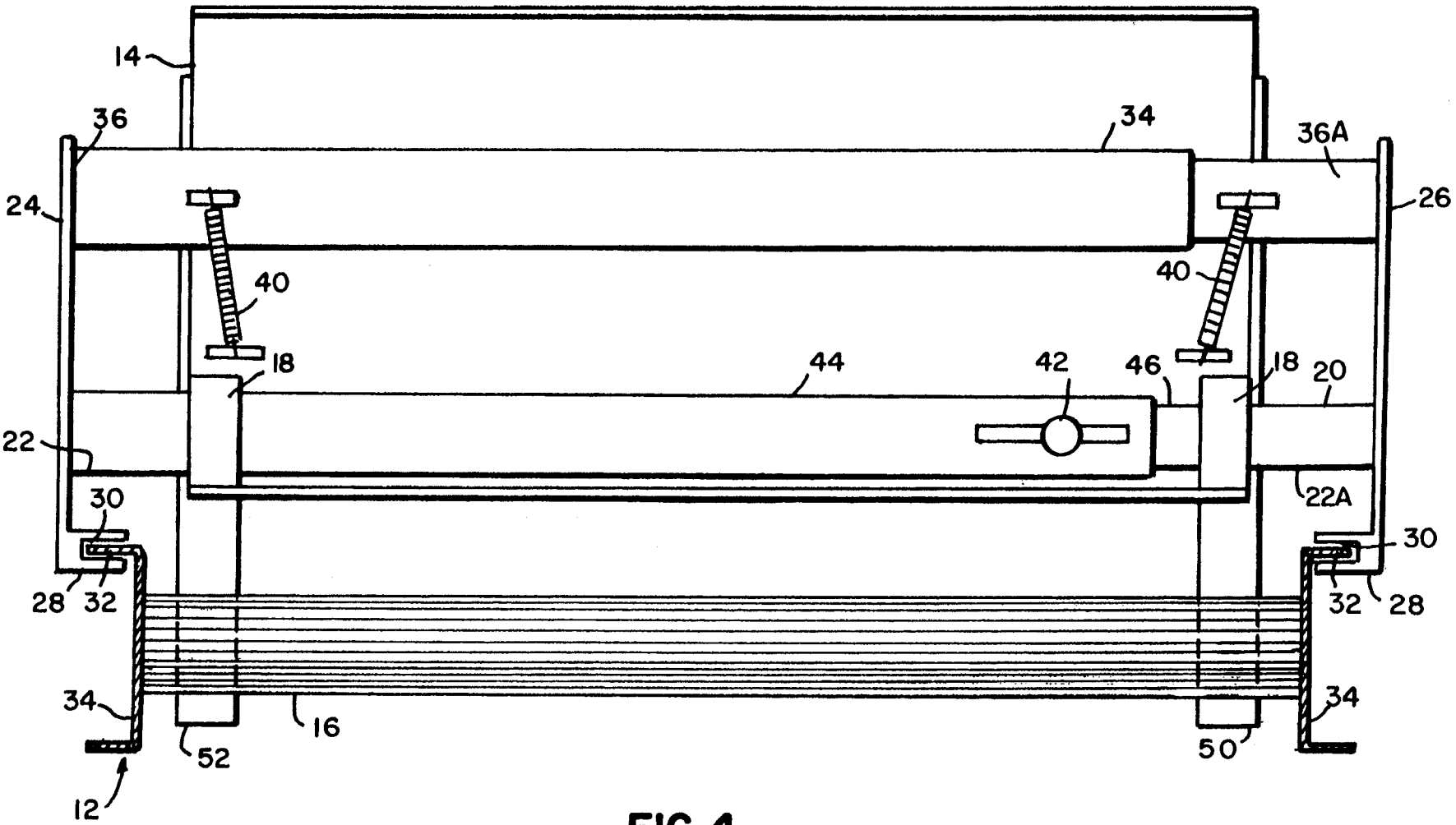
FIG. 4 is a plan view from the bottom of the platform.

A biasing arrangement 40 is disposed between the platform 14 and one of the support axles 20 and 34 or the side frames 24 and 26, as shown in FIGS. 2, 3 and 4. The biasing arrangement 40 comprises springs of the like, and act to center the platform 14 on its support axle 20. The first axle 20 and the second axle 34 are each telescopingly extendable. The first axle 20 has a biased pin 42 through an outer tube 44 and locks into receiving holes, not shown, in inner tube 46 to lock the longitudinal separation of the side frames 24 and 26 with respect the rail engaging means 30 and the side rail 34 of the ladder 12. This keeps the assembly 10 from separating and falling off of the ladder 12.

A pair of fingers 50 and 52 extend off of the forward edge 54 of the platform 14 and are arranged to rest upon a desired rung 16 of the ladder 12 on which the user desires to stand.

The platform 14 is pivotable, on its journal bearings 18, as shown in FIG. 3, so as to allow the plane of the platform 14 to be approximately parallel to the plane of the rails 34 of the ladder 12, to permit to be adjusted along the longitudinal length of the ladder 12.

Because the springs 40 act to pull the platform 14 against both support axles 20 and 34, the fingers 50 and 52 act as a brake to prevent undesired travel of the platform assembly 10 beyond one rung 16. Movement of the assembly 10 up or down the ladder 12 is accomplished by manually pivoting the platform 14 on the first axle 20 and moving the assembly 10 as desired, the fingers 50 and 52 resting on and holding the assembly 10 on that desired rung 16.

Thus what we have invented is a novel and unique platform assembly which provides a convenient, compact apparatus for assisting a user of an extension ladder, which is readily adjustable from a width-wise and vertical perspective, to avoid leg fatigue and provides user safety therewith.

We claim:

1. A ladder adaptable platform assembly for use on an extension ladder, the extension ladder having a pair of parallel side rails and spaced rungs, to provide a stepping surface in alignment with a rung of the extension ladder, said ladder adaptable platform comprising:

a platform surface arrangable onto the backside of a rung, pivotably supported between a pair of side frame, said side frame members slidably engageable with the side rails of a ladder thereattached;

an arrangement of a pair of support axles extending from a first to a second one of said side frame members, said platform surface being journalled about one of said support axles with the other of said support axles acting as an abutment for said platform;

a biasing arrangement disposed between said platform surface and said support axles or said side frame to permit said platform surface to pivot about one of said support axles with a pre-desired force, said biasing arrangement arranged to centralize said platform surface on the middle of said support axle arrangement.

2. A platform assembly as recited in claim 1, wherein said support axles are longitudinally adjustable.

3. A platform assembly as recited in claim 2, wherein at least one of said longitudinally adjustable support axles has a locking arrangement therewith to prevent dislodgement of said assembly from a ladder to which it is attached.

4. A platform assembly as recited in claim 1, wherein said platform surface pivots into a generally parallel plane with respect to the plane of a ladder to which it is attached.

5. A platform assembly as recited in claim 4, wherein said platform surface has a finger arrangement which extend from a forward edge of said surface, to rest upon a rung of a ladder to which it is attached.

6. A platform assembly as recited in claim 5, wherein said platform surface also rests upon said other support axle disposed between said pair of side frame members.

7. A platform assembly as recited in claim 7, wherein said side frame members are arranged so as to move only in the direction of a plane parallel to the plane of the ladder.

8. A method of adjusting a support for the user of an extension ladder comprising the steps of:

arranging a pair of side frame members in sliding engagement with the side rails of an extension ladder;

pivotably supporting a platform surface about a pair of support axles extending from a first to a second one of said slidable side frame members with said platform surface being journalled to one of said support axles, and the other of said support axles acting as a rest for said platform surface;

biasing said platform surface so as to tilt it with respect to said ladder;

moving said side frame members and said platform surface with respect to said ladder to adjust the height of the platform surface therewith.

* * * * *